United States Patent [19]

Senee et al.

[11] Patent Number: 4,894,931

[45] Date of Patent: Jan. 23, 1990

[54] HEATING DEVICE

[75] Inventors: Olivier Senee, Annecy; Philippe Billet, Annecy-Le-Vieux, both of France

[73] Assignee: Salomon S. A., Annecy Cedex, France

[21] Appl. No.: 298,232

[22] Filed: Jan. 9, 1989

Related U.S. Application Data

[63] Continuation of Ser. No. 86,986, Aug. 19, 1987, abandoned.

[30] Foreign Application Priority Data

Aug. 19, 1986 [FR] France ..... 86 11847

[51] Int. Cl.[4] ..... A43B 7/02; A43B 5/04

[52] U.S. Cl. ..... 36/2.6; 36/117; 44/3.1; 126/204; 165/46; 219/211

[58] Field of Search ..... 36/2.6, 117, 43, 44; 219/211, 527; 126/204, 206; 44/3.1; 128/382, 383, 462; 165/46

[56] References Cited

U.S. PATENT DOCUMENTS

| | | | |
|---|---|---|---|
| 266,205 | 10/1882 | Roth | 44/3.1 X |
| 1,894,775 | 1/1933 | Levenson | 44/3.1 X |
| 2,595,328 | 5/1952 | Bowen | 165/46 X |
| 2,680,918 | 6/1954 | Behner | 36/2.6 |
| 3,951,127 | 4/1976 | Watson et al. | 126/206 |
| 3,977,093 | 8/1976 | Santroch | 36/2.6 |
| 4,201,218 | 5/1980 | Feldman et al. | 219/211 X |

FOREIGN PATENT DOCUMENTS

| | | | |
|---|---|---|---|
| 130478 | 1/1985 | European Pat. Off. | 36/2.6 |
| 2365973 | 4/1978 | France | 36/2.6 |
| 60-13877 | 1/1985 | Japan | 128/402 |
| WO87/60803 | 11/1987 | World Int. Prop. O. | 36/2.6 |

*Primary Examiner*—James Kee Chi

*Attorney, Agent, or Firm*—Pollock, Vande Sande & Priddy

[57] ABSTRACT

A heating device incorporated in an article of clothing or a shoe, notably a ski boot, comprising a sealed enclosure (2) in contact with the area of the body to be heated, this enclosure containing a salt (5) which changes phase between solid and liquid and has a latent fusion heat close to the normal temperature of the area of the body, from 30° to 40° C., and in which the heating resistance (6) is in a heat exchange with the salt contained in the sealed enclosure (2) such that after heating of the salt, as it returns to its solid state, it progressively gives off heat for a long period of time, while maintaining a substantially constant comfortable temperature.

6 Claims, 1 Drawing Sheet

HEATING DEVICE

This application is a continuation of application Ser. No. 086,986, filed 08/19/87 now abandoned.

FIELD OF THE INVENTION

The present invention is a heating device incorporated in an article of clothing or a shoe, notably a ski boot.

BACKGROUND OF THE INVENTION

We already know of heating devices incorporated in articles of clothing such as gloves or in other clothing or in shoes, notably ski boots. These devices generally comprise an electrical heating resistance connected to a battery or a cell through a switch which can be shut off manually or automatically under the control of a system of temperature regulation including a temperature sensor. Such an electrical resistance heating device has the drawback that the cells used to supply the electricity for the heating resistance are used up very quickly, since the resistance must be used frequently in order to to maintain a desired comfortable temperatures.

SUMMARY OF THE INVENTION

The present invention aims to overcome the drawback by using a heating device of particularly simple conception, and by ensuring the maintenance of a comfortable temperature for a long period of time at the cost of a low consumption of electrical energy.

To this end, this heating device, incorporated in an article of clothing or a shoe, notably a ski boot, including an electrical heating resistance connected, through a switch, to a source of electrical current, this heating resistance being placed near a section of the body to be heated, has a sealed enclosure in contact with the section of the body to be heated, this enclosure containing a salt which changes between liquid and solid phase and has a latent fusion heat of a temperature close to the normal temperature of the section of the body, from 30 to 40° C., and in which the heating resistance is in a relation of heat exchange with the salt contained in the sealed enclosure such that the electrical current of the heating resistance, in a short period of time, causes the salt contained in the sealed enclosure to enter a liquid state, after which this salt, in returning to the solid state, progressively gives off heat over a long period of time, thereby maintaining a substantially constant comfortable temperature.

BRIEF DESCRIPTION OF THE DRAWINGS

In order that the invention may be more clearly understood, reference will now be made to the attached drawings in which several embodiments of the invention are shown for purposes of illustration, and in which.

DESCRIPTION OF PREFERRED EMBODIMENTS

Figure 1:
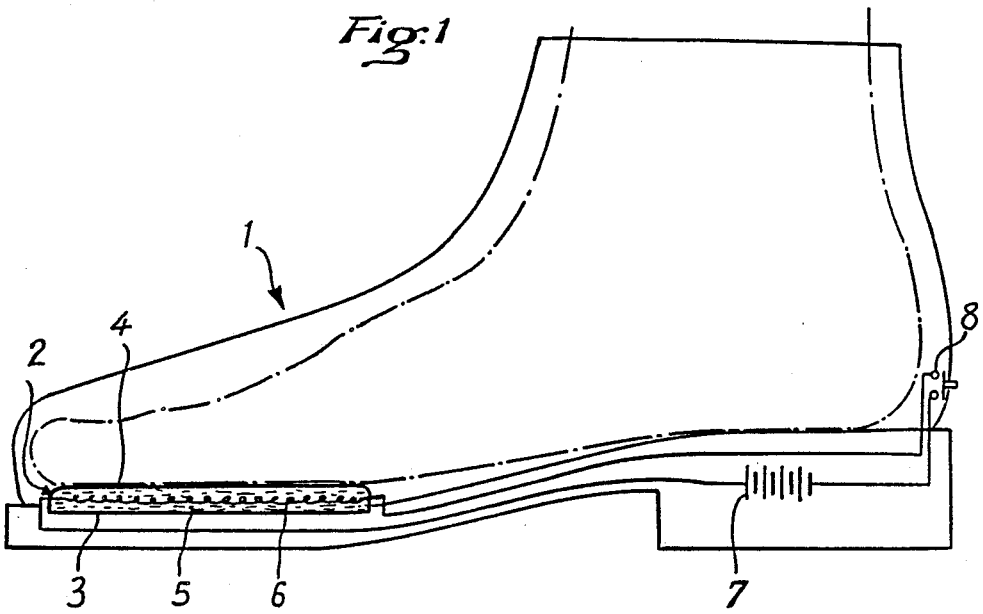
FIG. 1 is a vertical and longitudinal schematic section of a ski boot equipped with a heating device according to the invention.

FIG. 1 represents a ski boot 1 in the interior of whi incorporates a heating device according to the inve tion. This heating device includes a sealed enclosure which is placed on the insole of the shoe, inside t normally used inner casing. This sealed enclosure 2 c be constituted by two elements, namely a plate with rigid base 3, and a wall 4 of flexible material appli against the area to be heated and having good he conductivity. The sealed enclosure 2 contains a cert quantity of salt 5 which changes between liquid a solid phase and has a latent fusion heat and this salt chosen so that this change of phase takes place at temperature near the normal temperature of the area be heated, i.e., from 30 to 40° C.

Additionally, the sealed enclosure 2 contains an ele trical heating resistance 6 which is connected, by ele trical conductors, to a current source 7, such as a cell a battery, through a switch 8.

By way of example, the heating device according the invention could use, as a phase-changing salt wi latent fusion heat, disodium hydrogen phospha ($Na_2HPO_4$. $12H_2O$), which has a fusion temperature 33.5° C. The sealed enclosure 2 could contain for exa ple 25 grams of this salt. The resistance 6 could have value of 2.6 ohms, the heated surface area being 30 $mm^2$, while the heating surface of the electrical condu tor is 1100 $mm^2$. The supply of electrical current c come from two accumulators of the Ni-Cd type with electrical potential of 2.4 V and a capacity of 1.2 A. The base plate 3 of the sealed enclosure 2 is made o sheet of polyvinyl-polyethylene chloride with a thic ness of 500 micrometers having average heat conducti ity and good mechanical resistance. The upper wall 4 made of a film of polyamide-polyethylene with a thic ness of 50 micrometers having a very good heat co ductivity.

Figure 2:
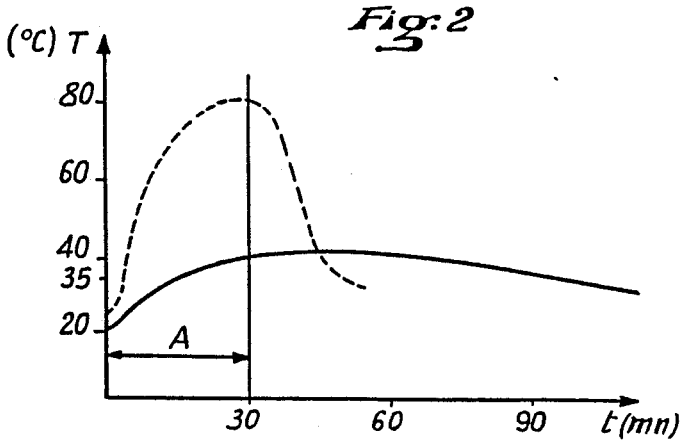
FIG. 2 is a diagram which illustrates the operation of the heating device according to the invention.

To use the heating device when the need arises, t skier closes the switch 8 which has the effect of trigge ing the supply of electrical current of the heating res tance 6 incorporated inside the sealed enclosure 2. T heat given off by the resistance 6 causes a progressi rise in the temperature in the interior of the sealed e closure 2, a temperature whose variation is indicated the full-line curve, as shown in FIG. 2, starting from t ambiant temperature which is presumed to be 20° The electrical resistance 6 furnishes by Joule's Effe the amount of heat necessary to cause the salt 5 to pa from solid phase to liquid phase. In the particular ca considered by way of example, in which the seal enclosure contains 25 grams of disodium hydrog phosphate, it is determined that at the end of 30 minut the salt has passed entirely into the liquid phase, and this moment, the heating is turned off by opening t switch 8. The heating period, i.e., the period duri which electricity flows through the electrical resistan 6, is indicated by Zone A in FIG. 2. At the end of th period, the temperature attained equals about 40° After the heating is cut off, the salt 5 returns progre sively to the solid state, releasing its heat for about o hour. As seen in FIG. 2, the temperature falls ve slowly throughout this one-hour period, remaini close to the comfort temperature of 35°.

By way of comparison, the temperature variati curve has been shown as a function of time when or the resistance heat (direct heating) is used (broken lir on FIG. 2). After 30 minutes of heating, the temperature attained is 80°, the inertia of the resistance provides about another 20 minutes of heat and the temperature falls back to 30° at the end of this period. The effect of the heating is thus shorter and more violent than in the case when one uses the salt 5 with latent fusion heat.

Another advantage obtained by means of the heating device according to the invention is that, if the temperature at which the phase change occurs is exactly the same as the normal temperature of the foot, an adjustment of the latter temperature is produced automatically. In effect, if the foot is too hot, the salt absorbs the excess calories by passing to the liquid state while on the other hand if the foot becomes too cold, the salt returns to the solid state by releasing calories.

To avoid the salt 5 in liquid phase spilling under the toes, its displacement can be limited by incorporating it in a gel incorporated in the interior of the sealed pouch 2 to act as a sponge.

While the preceding indicated that the heating device 2,6 is placed under the toes of the foot, it is evident that it could be placed anywhere in the shoe and that it could in particular be formed as a complete insole placed in an inner shell which will assure that the impression of the plantar support of the skier will be made during the solidification of the mixture in the enclosure 2.

Figure 3:
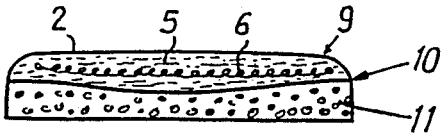
FIG. 3 is a vertical and cross-wise sectional view of a second embodiment of the heating device according to the invention.

In the embodiment shown in FIG. 3 the sealed enclosure 2 is the upper part 9 of the insole 10 which contacts the foot, while the lower part 11 of this insole, to which the upper sealed enclosure 5 is attached, is made of a heat insulating material.

The heating device according to the invention can be incorporated in any article of clothing, notably in a glove, a helmet and any other wearables.

It is possible to include a temperature display and a temperature gauge which would permit the automatic triggering of the electrical heating resistance when the temperature of the body area to be heated falls below a predetermined level.

What is claimed is:

1. A heating device incorporated in an article of wear, notably a ski boot, comprising an electrical heating resistance connected, by a switch, to a current source, said heating resistance being located adjacent a foot to be heated, said device comprising a sealed enclosure (2) in contact with said foot, containing a salt (5) which changes phase between liquid and solid and has a latent fusion heat of a temperature close to the normal temperature of said foot in the range of 30° to 40° C., said heating resistance (6) being in a heat exchange relation with said salt and constituting means for liquefying said salt by heat exchange for a short period of time, termination of said heat exchange causing said salt to return to a solid state, releasing heat progressively over a prolonged period of time, while maintaining a substantially constant comfortable temperature.

2. A device according to claim 1, wherein said sealed enclosure (2) comprises a rigid base plate (3) and a wall (4) of flexible material applied against said foot and having good heat conductivity.

3. A device according to claim 1, wherein said salt is constituted by disodium hydrogen phosphate ($Na_2HPO_4 \cdot 12\ H_2O$), which has a fusion temperature of 35.5° C.

4. A device according to claim 1, wherein said salt (5) is incorporated in a gel placed inside said sealed enclosure (2) and acts as a sponge.

5. A device according to claim 1, wherein said sealed enclosure (2) constitutes an upper part (9) of an insole (10) contacting said foot, a lower constitutive part (11) of said insole, to which said sealed enclosure (5) being attached, is made of heat insulating material.

6. Process for heating a foot housed in footwear, comprising the steps of (a) providing a heating resistance in said footwear adjacent said foot;

(b) providing a sealed enclosure in contact with said foot, said enclosure containing a salt which changes phase between liquid and solid and has a latent fusion heat of a temperature close to the normal temperature of said foot, in the range of 30° to 40° C., said heating resistance being in heat exchange relation to said salt;

(c) passing an electrical current through said heating resistance for a first period of time sufficient to cause said salt to pass from solid phase to liquid phase;

(d) terminating passage of said electrical current when said salt has passed entirely into liquid phase, whereby said salt returns progressively to solid state over a second period of time of greater duration than said first period of time, releasing stored up heat so as to cause heating of said foot.

* * * * *